US006893727B2

(12) United States Patent
Adachi et al.

(10) Patent No.: US 6,893,727 B2
(45) Date of Patent: May 17, 2005

(54) METAL GASKET AND A MATERIAL FOR ITS MANUFACTURE AND A METHOD FOR THEIR MANUFACTURE

(75) Inventors: Kazuhiko Adachi, Amagasaki (JP); Seishi Ishiyama, Nishinomiya (JP); Kenichi Goshokubo, Nigata (JP); Takashi Katsurai, Tochigi (JP)

(73) Assignees: Sumitomo Metal Industries, Ltd., Osaka (JP); Honda Giken Kogyo Kabushiki Kaisha, Tokyo (JP)

( * ) Notice: Subject to any disclaimer, the term of this patent is extended or adjusted under 35 U.S.C. 154(b) by 52 days.

(21) Appl. No.: 10/691,657

(22) Filed: Oct. 24, 2003

(65) Prior Publication Data

US 2004/0121169 A1 Jun. 24, 2004

Related U.S. Application Data

(63) Continuation of application No. PCT/JP02/04136, filed on Apr. 25, 2002.

(30) Foreign Application Priority Data

Apr. 27, 2001 (JP) ..... 2001-132773

(51) Int. Cl.[7] ..... B32B 15/06; C22C 38/40; C21D 9/00; F16J 9/26

(52) U.S. Cl. ..... 428/465; 420/34; 420/56; 420/59; 420/119; 420/128; 420/129; 148/516; 148/537; 148/580; 148/605; 148/607; 148/608; 148/609; 148/611; 148/621; 148/325; 148/326; 148/336; 148/908; 277/592; 277/596

(58) Field of Search ..... 428/465; 420/34, 420/56, 59, 119, 128, 129; 148/516, 537, 580, 605, 607, 608, 609, 611, 621, 325, 326, 336, 908; 277/592, 596

(56) References Cited

U.S. PATENT DOCUMENTS 6,277,215 B1 * 8/2001 Adachi et al. ..... 148/325

FOREIGN PATENT DOCUMENTS

| | | |
|---|---|---|
| JP | 63-206428 | 8/1988 |
| JP | 63-206429 | 8/1988 |
| JP | 04-214841 | 8/1992 |
| JP | 05-117813 | 5/1993 |
| JP | 05-279802 | 10/1993 |
| JP | 08-134595 | 5/1996 |
| JP | 08-134596 | 5/1996 |
| JP | 11-140598 | 5/1999 |

* cited by examiner

*Primary Examiner*—Robert R. Koehler
(74) *Attorney, Agent, or Firm*—Clark & Brody

(57) ABSTRACT

This invention relates to a stainless steel gasket having markedly improved strength and fatigue properties due to precipitation strengthening. Its composition comprises C: at most 0.03%, Si: at most 1.0%, Mn: at most 2%, Cr: 16.0%–18.0%, Ni: 6.0%–8.0%, N: at most 0.25%, if necessary Nb: at most 0.30%, and a remainder of Fe and unavoidable impurities. After cold rolling, final annealing is carried out, and after a structure is formed of recrystallized grains with an average grain diameter of at most 5 $\mu$m having an area ratio of 50–100% and an unrecrystallized portion having an area ratio of 0–50%, a metal gasket is formed by steps including temper rolling with a reduction of at least 30% to make the area ratio of a strain induced martensite phase at least 40%, and forming and heat treatment at 200–350° C. The metal gasket has a duplex phase structure of at least 40% martensite in which chromium nitride is precipitated and a remainder of austenite, or it has a single phase structure of martensite in which chromium nitride is precipitated, and it has Hv of at least 500.

11 Claims, 2 Drawing Sheets

Fig. 2(a)
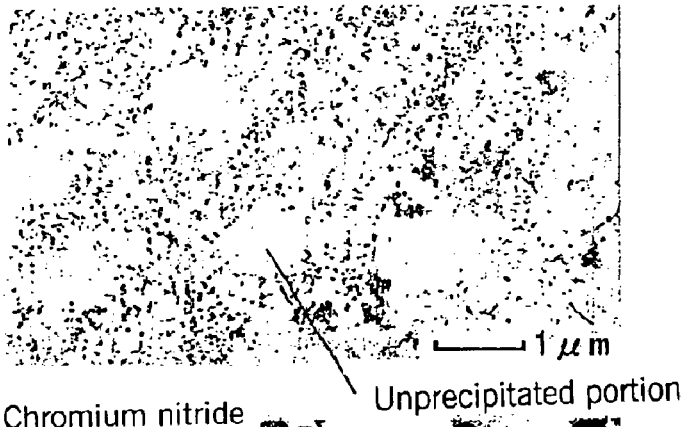
Fig. 2(b)
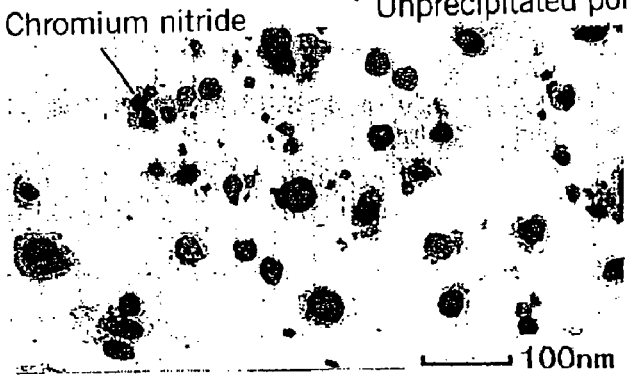
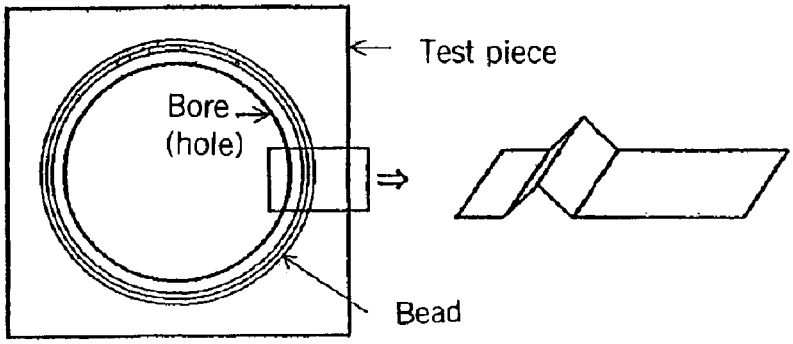
Fig. 3(a) Fig. 3(b)

METAL GASKET AND A MATERIAL FOR ITS MANUFACTURE AND A METHOD FOR THEIR MANUFACTURE

METAL GASKET AND A MATERIAL FOR ITS MANUFACTURE AND A METHOD FOR THEIR MANUFACTURE

This application is a continuation of International Patent Application No. PCT/JP02/04136 filed Apr. 25, 2002. This PCT application was not in English as published under PCT Article 21(2)

TECHNICAL FIELD

This invention relates to a metal gasket and particularly a metal gasket for an engine of an automobile or a motorcycle or the like, to a stainless steel for use in its manufacture, and to a method for their manufacture.

Below, the present invention will be explained in particular using a metal gasket for an engine as an example, but a metal gasket according to the present invention is not limited thereto.

BACKGROUND ART

An engine gasket referred to as a head gasket is a sealing member which is mounted between a cylinder head and a cylinder block and which prevents leakage of combustion gas or engine cooling water or oil.

In the past, as a head gasket, a composite type gasket having a structure in which a compressive member was wrapped in mild steel was used, but at present, almost all are metal gaskets essentially comprising a metal sheet.

A metal gasket for an engine (a head gasket) has the same outline as the portion to be sealed with the gasket and is constructed from about three sheets of stainless steel having circular holes corresponding to combustion chambers (cylinders) stacked on top each other. An annular projection referred to as a bead is formed around each hole in the gasket [see FIGS. 3(*a*) and (*b*)], and sealing with respect to a high-pressure combustion gas or the like is guaranteed by intimate contact resulting from the resilience of the bead. The entire surface of the gasket on the outer side of the bead is thinly coated with rubber in order to prevent the formation of scars on the surface of the steel sheets and to prevent the leakage of cooling water, oil, and the like running along the gasket. When forming the coating of rubber, heat treatment is typically carried out at a temperature up to about 350 ° C. for a few minutes.

In the past, SUS 301 and SUS 304, which are metastable austenitic stainless steels, were widely used in metal gaskets for engines. These materials are normally used after cold rolling (temper rolling) performed for the purpose of strength adjustment. Due to work hardening accompanying strain induced martensitic transformation, a high strength is obtained relatively easily. In addition, due to the hardening caused by strain induced martensitic transformation in deformed portions, the so-called TRIP effect in which the material is uniformly deformed with suppressed local deformation is obtained, so these steels are distinguished among various stainless steels as having excellent workability.

However, even with these materials, as is the case with other metal materials, a decrease in workability accompanying an increase in strength is unavoidable. With these materials, it is difficult to both satisfy an even higher strength which is demanded with an increase in the output of recent engines and a sufficient level of workability to form complicated shapes which are desired as weights decrease, i.e., as sizes decrease.

The above-described stainless steels, if they are in the form of a flat sheet, as their strength increases, their fatigue strength also increases. However, when they are used to form conventional metal gaskets for engines, as the shape of the gaskets becomes more complicated, it was observed that defects such as cracks (minute cracks in the surface of the steel sheet), wrinkles, and the like occurred at the time of bead formation due to insufficient workability of the steel material, thereby causing a significant decrease in fatigue properties after working.

Therefore, there have been many proposals of methods in which working (such as by punching and bead formation) of a stainless steel sheet into a gasket is carried out in a state in which necessary workability can be guaranteed (before strengthening), and then heat treatment is carried out to achieve age hardening in order to increase strength.

Specifically, a material which uses a steel corresponding to the above-mentioned SUS 301 or SUS 304 and which is increased with respect to resistance to elastic deformation (spring properties) such as Young's modulus and proportional limit of spring by strain aging and a manufacturing method therefor are proposed in JP P03-68930B and P07-65110B. A high strength material having increased hardness and strength (tensile strength) by the addition of a precipitation strengthening element such as Si, Mo, Cu, or Ti and a method for its manufacture are disclosed in JP P04-214841A and P05-117813A.

In addition, the use of a precipitation strengthening type stainless steel such as SUS 630 or SUS 631 which achieves high strength primarily by precipitation strengthening has also been proposed.

However, while strain aging improves spring properties and increases the resiliency of a bead, the increase in hardness and strength is small. Therefore, when a gasket is mounted between a cylinder head and a cylinder block and clamped by bolts or the like, there was the problem that permanent set in which the bead was crushed and its height decreased took place.

On the other hand, precipitation strengthening typically requires heat treatment for a long period at a relatively high temperature of 400–600° C. Since a rubber coating cannot withstand such a high temperature, heat treatment for precipitation strengthening must be carried out after working of the gasket and before rubber coating. It is a heavy burden for gasket manufacturers to perform heat treatment at such a high temperature, and due to addition of the step of heat treatment for precipitation strengthening, the process of manufacturing a gasket becomes complicated. Therefore, in the past, it was difficult to make practical use of a metal gasket having an increased strength by use of precipitation strengthening. Another problem of the heat treatment performed at a high temperature for a long period for the purpose of precipitation strengthening is that it tends to cause the formation of coarse precipitates, which become a starting point from which fatigue fracture originates.

An object of this invention is to provide a high performance metal gasket which can be advantageously manufactured industrially and which has high strength and good fatigue properties so as to enable it to be utilized in recent high performance engines, as well as a method for its manufacture.

Another object of this invention is to provide a stainless steel for a metal gasket which has excellent workability at the time of working to form into a gasket and which undergoes precipitation strengthening by heat treatment at a temperature of around 300° C. (200–350 ° C.) which is performed at the time of rubber coating so that it can be used to manufacture the above-described high performance metal gasket without performing additional heat treatment for precipitation strengthening, as well as a method for its production.

DISCLOSURE OF THE INVENTION

According to one aspect, the present invention is a stainless steel for a metal gasket having a chemical composition consisting essentially of, in mass %, C: at most 0.03%, Si: at most 1.0%

Mn: at most 2.0%, Cr: at least 16.0% and at most 18.0%,

Ni: at least 6.0% and at most 8.0%, N: at most 0.25%, optionally Nb: at most 0.30%, and a remainder of Fe and unavoidable impurities, and having either a duplex phase structure of martensite with an area ratio of at least 40% and a remainder of austenite, or a single phase structure of martensite, the stainless steel being capable of producing a metal gasket having Hv of at least 500 and having chromium nitride precipitated in the martensite phase by aging after forming.

From another standpoint, the present invention is a metal gasket comprising a high strength stainless steel with Hv of at least 500 having the above-described chemical composition and having either a duplex phase structure of martensite in which chromium nitride is precipitated with an area ratio of at least 40% and a remainder of austenite, or a single phase structure of martensite in which chromium nitride is precipitated.

In the present invention, the area ratio of the martensite phase is a value calculated from the integrated intensity ratio of the peak of each phase in an X-ray diffraction pattern. The stainless steel may contain inclusions which are unavoidably formed in its manufacture.

The present invention also provides a method of producing a stainless steel for a metal gasket characterized by including a step of performing final annealing of a cold rolled steel having the above-described chemical composition so as to form a recrystallized structure having recrystallized grains with an average grain diameter of at most 5 μm having an area ratio of 50–100% and an unrecrystallized portion having an area ratio of 0–50%, and a step of then performing temper rolling of the cold rolled steel with a reduction of at least 30%.

The grain diameter of the recrystallized grains and the area ratio thereof is a value found by observation of the surface or a cross section of a test piece under an optical or electron microscope.

A stainless steel which is useful for manufacturing a metal gasket which is produced in this manner has excellent workability, and it can be worked into a complicated shape. In addition, when the stainless steel is subsequently subjected to heat treatment at a temperature of 200–500° C., its strength is markedly increased by age hardening (namely, precipitation strengthening) resulting from precipitation of chromium nitride, and its fatigue properties are also improved.

This age hardening can be achieved by heat treatment at a temperature up to about 350° C. which is carried out during the step of rubber coating in the manufacture of a metal gasket, so separate heat treatment just for the purpose of age hardening is not necessary. Therefore, a high strength metal gasket having excellent fatigue properties can be manufactured by the same manufacturing process as one which does not utilize precipitation strengthening (without it being necessary to have a separate heat treatment step) while suppressing the formation of defects at the time of bead formation.

The present invention also provides a method of manufacturing a metal gasket comprising forming the above-described stainless steel or a stainless steel produced by the above-described method, and carrying out aging and rubber coating of the formed piece at 200–500° C. As already stated, it is industrially advantageous to carry out the aging by heat treatment at a temperature of at most 350° C. at the time of rubber coating.

BRIEF DESCRIPTION OF THE DRAWINGS

FIGS. 2(*a*) and 2(*b*) are electron micrographs at different magnifications showing chromium nitride which precipitated from materials which underwent heat treatment at 300° C. for ten minutes for age hardening.

FIG. 3(*a*) is a schematic view from above of a test piece after it has undergone bead formation in an example, and FIG. 3(*b*) is a schematic view showing an enlarged cross-sectional shape of a bead portion of this test piece.

DETAILED DESCRIPTION OF THE INVENTION

Figure 1:
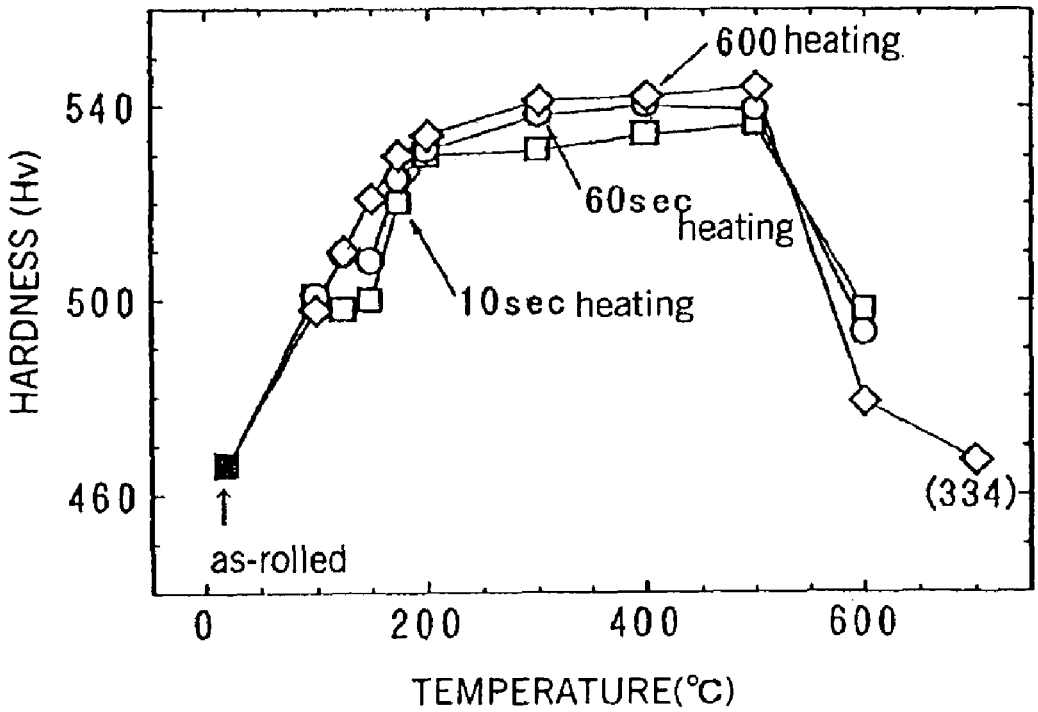
FIG. 1 is a graph showing the variation in Vickers hardness (Hv) as a function of heat treatment temperature when a steel to be worked which was produced by the method according to the present invention was subjected to heat treatment of various durations for age hardening.

The present invention is based on the finding that when a gasket is manufactured from an existing austenitic stainless steel having a chemical composition corresponding to SUS 301L, if a sufficient amount of martensitic transformation is induced by temper rolling which is carried out at a final stage of the production of steel material, chromium nitride can be precipitated by aging at a temperature of 350° C. or lower which can be achieved by heat treatment which is carried out during a rubber coating step in the process of manufacturing a gasket and which is considerably lower than a conventional temperature for age hardening, thus making it possible to significantly strengthen the material to Hv 500 or above.

It has been found that when the grain boundary density is increased by final annealing so as to facilitate the diffusion of the constituent elements of precipitates (Cr, N, and the like), the precipitation of chromium nitride occurs in the martensite phase which is formed by strain induced transformation during temper rolling, the martensite phase having a nitrogen dissolution limit which is decreased compared to the austenite mother phase. Accordingly, a stainless steel which forms a gasket according to the present invention has either a duplex phase structure of martensite in which chromium nitride is precipitated and a remainder of austenite, or a single phase structure of martensite in which chromium nitride is precipitated.

In order to obtain the marked age hardening exhibited by an increase in the Vickers hardness (Hv) of at least 50 by the above-described aging, the amount of the martensite phase which is the phase which precipitates chromium nitride must be sufficiently large. Specifically, in the case of the above-described duplex phase structure, the martensite phase must have an area ratio of at least 40%.

A hardness of Hv 500 is thought to be at or near the upper limit of the hardness for a stainless steel obtainable by cold rolling alone. The hardness of a stainless steel constituting a gasket according to the present invention is preferably at least Hv 520 which is effective for increasing the performance of a gasket and which is difficult to obtain with cold rolling.

The above-described age hardening and steel structure can be achieved by manufacturing a gasket from a stainless steel including a strain induced martensite phase which is obtained by performing final annealing of a cold rolled steel so as to form a recrystallized structure in which recrystallized grains having an average grain is diameter of at most 5 $\mu$m occupy an area ratio of at least 50% and the remainder (if present) is an unrecrystallized portion [below, this structure will be referred to as a "(partially) recrystallized structure"] followed by temper rolling.

The reasons why the chemical composition of a stainless steel constituting a gasket according to the present invention is prescribed in the above manner will next be explained. In the following explanation, "%" as used with respect to the chemical composition at all times means "mass %".

C: At most 0.03%, and preferably at least 0.01% and at most 0.025%

If the C content is too high, during the final annealing which is carried out at a relatively low temperature in order to obtain a (partially) recrystallized structure, it leads to precipitation of a large amount of chromium carbide, and it is difficult to obtain a corrosion resistance which can withstand actual use as a stainless steel. In addition, the precipitation of chromium nitride is hindered during rubber coating, and the workability of the material is deteriorated.

Furthermore, along with N, C is the strongest austenite stabilizing element, and if too much C is added, martensitic transformation is suppressed. However, again along with N, C is one of the most effective elements for strengthening a steel material, so it is desirable to add it within a range in which precipitation of the above-described carbides is suppressed.

Si: at most 1.0%, preferably at least 0.2% and at most 0.8%

Si is a solid solution hardening element, and it has an effect of making it easier to obtain a (partially) recrystallized structure. However, workability becomes poor if too much Si is contained.

Mn: at most 2.0%, preferably at least 0.2% and at most 1.8%

Mn is an austenite stabilizing element and is added while taking into consideration the balance with other elements. If too much Mn is added, there are cases in which a strain induced martensite phase is not obtained, and it can lead to a decrease in the workability of a material due to the formation of inclusions and the like.

Cr: at least 16.0% and at most 18.0%, preferably at least 16.4% and at most 17.9%

Cr is a fundamental element of stainless steel. In order to obtain sufficient corrosion resistance to withstand actual use, at least 16.0% is added. In the present invention, Cr performs an important role in age hardening as a constituent element of chromium nitride. However, Cr is a ferrite stabilizing element, so if the added amount thereof is too large, it leads to the presence of a ferrite phase in the steel.

Ni: at least 6.0% and at most 8.0%, preferably at least 6.1% and at most 7.6%

Except for C and N, Ni is the most powerful and effective austenite stabilizing element among alloying elements, and it is an essential element for obtaining an austenite phase structure at room temperature. However, if too much Ni is added, a strain induced martensitic transformation will no longer take place during temper rolling. In order to obtain a metastable austenite state at room temperature and to obtain the necessary strength and good workability due to the above transformation after cold rolling, Ni is included in the above-described amount.

N: at most 0.25%, preferably at least 0.08% and at most 0.24%

N is a constituent element of chromium nitride. In addition, when Nb is added, as described below, due to the addition of N, niobium nitride also precipitates at the time of final annealing, and it is thought to have the effect of making it easier to obtain a (partially) recrystallized structure. Along with C, N is one of the most effective elements for strengthening a steel material. In order to obtain the above effects with certainty, preferably at least 0.06% of N is added. However, like C, N is a strong austenite stabilizing element, so as the amount thereof which is added increases, martensitic transformation is suppressed. In addition, excessive addition of N makes it difficult to manufacture a steel sheet.

Nb: 0–0.30%, preferably at least 0.03% and at most 0.26%

Nb precipitates as niobium nitride at the time of final annealing, and it has the effect of making it easier to obtain a (partially) recrystallized structure, so optionally it may be added. When Nb is added, in order to obtain the above-described effect, it is preferable to add at least 0.01% thereof. However, Nb is an extremely expensive element, so addition of a large amount thereof makes the material extremely expensive.

The remainder of a stainless steel used in the present invention is made up of Fe and unavoidable impurities. However, if desired, in addition to the above-described components, there is no problem with including as necessary at most 0.05% of each of added elements responding to industrial demands, such as Ca or REM (rare earth metals) used as a deoxidizer at the time of preparing a molten metal, B for the purpose of improving hot workability, and the like.

The material containing the above-described chemical composition is subjected to the steps of melting, casting, hot rolling, cold rolling, and the like to obtain a cold rolled steel, and final annealing and temper rolling according to the present invention are carried out to manufacture a stainless steel which can be used as a material for working.

Manufacture of the stainless steel material for working can be carried out by a conventional method up through cold rolling. Cold rolling is preferably carried out with a reduction of at least 40%.

The cold rolled stainless steel (cold rolled steel) is annealed. In order to distinguish this annealing after cold rolling from annealing carried out during cold rolling, in this invention it is referred to as "final annealing". This final annealing is carried out so that after final annealing, a (partially) recrystallized structure is obtained in which recrystallized grains having an average grain diameter of at most 5 $\mu$m have an area ratio of 50–100%, and the remainder (if any) is an unrecrystallized portion.

Fine recrystallized grains of this type can be precipitated by performing annealing at a relatively low temperature and for a short length of time. For example, the annealing conditions can be set within a range of a heating temperature of 750–950° C. and a heating time of 1–300 seconds so as to obtain the above-described recrystallized structure. As a result of this annealing, a stainless steel having the above-described chemical composition easily form the above-described fine (partially) recrystallized structure.

Final annealing is carried out so that expanded grains formed by cold rolling do not remain. Expanded grains are coarse, so if they remain, various properties including fatigue properties are deteriorated.

If the structure after final annealing is a fine (partially) recrystallized structure in which recrystallized grains having an average grain diameter of at most 5 μm occupy at least half of the cross-sectional area, the grain boundary density increases, so diffusion of precipitate-constituting elements (Cr, N, and the like) during subsequent heat treatment is promoted. As a result, during the heat treatment at a low temperature of around 300° C. which is carried out in the rubber coating step after forming the metal gasket, chromium nitride easily precipitates in the strain induced martensite phase and the material is age hardened, and due to this heat treatment, the hardness of the material expressed as Hv can be increased by at least 50. In this manner, good workability before aging can be guaranteed, and good strength and fatigue properties after aging can be obtained.

If the average grain diameter of the recrystallized grain exceeds 5 μm or if the area ratio thereof is less than 50%, it becomes difficult to obtain the above effect. In addition, even if the effects are obtained, workability after temper rolling is insufficient. The area ratio of recrystallization is preferably at least 60%, more preferably at least 80%, and it may even be 100% (namely, a completely recrystallized structure).

After final annealing, temper rolling with a reduction of at least 30% is carried out. This is in order to guarantee a hardness of at least Hv 500 by the aging which is subsequently performed. As a result of this temper rolling, a strain induced martensite phase is formed with an area ratio of at least 40%, and a microstructure is obtained which is either a duplex phase structure of martensite with an area ratio of at least 40% and a remainder of austenite or a single phase martensite structure. The reduction during temper rolling is preferably 35–60%, and a martensite phase with an area ratio of at least 50% is preferably formed by this temper rolling.

Precipitation of chromium nitride occurs in the martensite phase which has a low nitrogen dissolution limit compared to the austenite mother phase. If martensite is formed in a large quantity with an area ratio of at least 40% by the temper rolling, due to subsequent aging, even if the aging temperature is in a low range of 200–350° C., it is possible to obtain effective age hardening with an increase of at least 50 Hv, and a hardness of at least Hv 500 can be obtained after aging.

A stainless steel which is manufactured in this manner has good workability, and it can withstand the complicated and severe bead forming which is necessary for manufacturing a small gasket which can cope with reductions in the size of engines. If aging is carried out after this forming, due to the age hardening by precipitation of chromium nitride in the martensite phase, Hv increases by at least 50, the strength is increased to at least Hv 500, and fatigue properties are also improved. This age hardening can be carried out by aging at a relatively low temperature of around 300° C. and more generally in the range of 200–500° C.

FIG. 1 shows the hardness (Hv) measured using a micro Vickers hardness meter after aging was carried out at different temperatures (a heating duration of 10 seconds, 60 seconds, or 600 seconds) on stainless steel sheets which were manufactured in accordance with the method according to the present invention by performing final annealing and temper rolling after cold rolling.

As can be see from FIG. 1, this stainless steel already begins to harden at a heat treatment temperature of 100° C., the hardening markedly increases at 200° C. and above, and it exhibits a high hardness exceeding Hv 530. However, if the heat treatment temperature exceeds 500° C., the hardness begins to decrease, so a preferred temperature for aging is in the range of 200–500° C.

FIG. 2(*a*) shows chromium nitride which precipitated in the above-described stainless steel sheet material during aging at 300° C. for 600 seconds (10 minutes). The precipitates were observed by the replica method using a transmission electron microscope (TEM). In the figure, the white regions correspond to unprecipitated regions, and the black marks in the precipitated portions are precipitated chromium nitride. FIG. 2(*b*) is an enlarged view of a precipitated portion of FIG. 2(*a*).

As shown in FIGS. 2(*a*) and (*b*), precipitation of fine chromium nitride was ascertained in the stainless steel after aging. Variations were observed in the distribution of precipitates, and a low density unprecipitated portion having a size roughly corresponding to the average grain diameter (approximately 1 μm) of the recrystallized grains after final annealing was ascertained. This unprecipitated portion is thought to be a region corresponding to an austenite phase which has a high solid solution limit of N compared to martensite and in which it is difficult for chromium nitride to precipitate.

A metal gasket can be manufactured by a conventional method from a stainless steel (sheet) manufactured by the method according to the present invention. Manufacture of a metal gasket is typically carried out by forming including bead forming followed by rubber coating.

Forming can be carried out by any suitable method, but typically, it is carried out by punching followed by bead forming to obtain a prescribed gasket shape. Then, aging is carried out at a temperature of 200–500° C. and preferably of at most 350° C. to guarantee a hardness of at least Hv 500.

During aging, chromium nitride precipitates in the martensite phase which is induced by temper rolling with an area ratio of at least 40%. If the aging temperature is less than or equal to 500° C., the area ratio of the martensite phase does not substantially change between before and after aging, so the microstructure of the stainless steel after aging is a duplex phase structure of martensite with an area ratio of at least 40% in which chromium nitride is precipitated and a remainder of austenite, or it is a single phase martensite structure in which chromium nitride is precipitated.

Rubber coating is carried out by thinly coating (such as with a dry film thickness of 10–30 μm) the entire surface of the gasket except for the bead with a coating fluid containing rubber and then performing heat treatment to crosslink the rubber. Heat treatment is normally carried out at a temperature of at most 350° C. In the manner described above, in the present invention, an increase in strength occurs due to age hardening of the stainless steel during heat treatment at such a temperature.

Accordingly, in a manufacturing process for a gasket, it is not necessary to perform separate heat treatment for the purpose of aging after forming, and aging can be simultaneously carried out by heat treatment at 200–350° C. at the time of rubber coating. In this case, in spite of the fact that an increase in the strength of the steel material due to precipitation strengthening is utilized, in contrast to manufacture of a conventional metal gasket using precipitation strengthening, a special heat treatment step for precipitation strengthening (normally carried out at a temperature of 400–600° C. at which energy costs are high) becomes unnecessary, so it is extremely advantageous from an economic standpoint. Naturally, it is possible to carry out heat treatment at 200–500° C. for aging prior to and separately from the heat treatment for rubber coating.

A stainless steel produced by the method according to the present invention has good workability, and it is given a high strength if aging is carried out a temperature of 200–500° C. after working, so it is particularly suitable for manufacture of a metal gasket, but it also can be utilized for forming items other than gaskets.

The present invention will be described in further detail by the following examples. These examples are for the purposes of illustration and do not limit the present invention.

EXAMPLES

Stainless steels having the compositions shown in Table 1 were melted in a vacuum melting furnace and hot rolled and then repeatedly subjected to annealing and cold rolling. The resulting cold rolled steel sheets were subjected to final annealing under conditions selected from a temperature of 700–1100° C. and a heating time of 1–600 seconds, and then temper rolling was performed. The sheet thickness (t) after temper rolling was made 0.2 mm in all cases. The temper rolled steel sheets were cut to 170×170 mm, and the resulting test pieces were press formed using a prescribed die designed to form beads having the cross-sectional shape shown in the plan view and the perspective view of FIGS. 3(*a*) and 3(*b*), respectively, which had an annular shape having a diameter of approximately 60 mm, and finally subjected to aging at 300° C. for 1 minute.

In addition, a test piece was taken from the stainless steel sheet after each of final annealing, temper rolling, and aging and subjected to the following investigation.

For microstructure, the average grain diameter of recrystallized grains and the area ratio of recrystallized grains after final annealing were found by observation of a cross section of a test piece using an optical microscope, a scanning electron microscope (SEM), and a transmission electron microscope (TEM). The average grain diameter and the area ratio were the average value of 4 randomly selected fields of view. When expanded grains were ascertained in the structure, it was not a structure comprising recrystallized grains and a remainder of an uncrystallized portion, so the average grain diameter and the area ratio of the recrystallized grains were not calculated.

As described previously with respect to FIGS. 2(*a*) and 2(*b*), the presence or absence of chromium nitride (precipitates) after aging was ascertained by observation using the replica method with a TEM.

The amount of martensite (α') after temper rolling was calculated from the integrated intensity ratio for the martensite phase peak in an x-ray diffraction graph. The value of α' after aging is substantially the same as the value after temper rolling.

The hardness was measured with a micro Vickers hardness meter after each of final annealing, temper rolling, and aging. In order to evaluate age hardening, the difference (increase in strength) between the hardness after temper rolling and that after aging was calculated as ΔHv.

Workability, permanent set properties, and fatigue properties were investigated in the following manner using test pieces in which a bead had been formed.

Workability was evaluated using test pieces after bead formation (before aging) based on the presence or absence of cracks on the surface on the outer periphery and the inner periphery of the beads as ○ (no cracks) or × (cracks present).

Permanent set was caused by completely crushing the bead of a test piece after bead formation and of a test piece after aging using a compression testing machine. The bead height was measured before and after compression, and permanent set properties were evaluated based on the proportion of the bead height after compression to that before compression.

Fatigue properties were tested by applying repeated compression with a prescribed amplitude $10^7$ times to a test piece after aging using a repeating compression test machine, and they were evaluated based on the presence or absence of cracks passing through the thickness as ○ (no cracks passing through the thickness) or × (presence of cracks passing through the thickness).

The results of the above investigations and the treatment conditions are together shown in Table 2.

TABLE 1

| | Chemical composition (mass %) | | | | | | | | | |
|---|---|---|---|---|---|---|---|---|---|---|
| Mark | C | Si | Mn | P | S | Cr | Ni | N | Nb | |
| A | 0.028 | 0.53 | 1.81 | — | — | 17.93 | 7.52 | 0.098 | — | present |
| B | 0.019 | 0.67 | 1.51 | — | — | 17.13 | 6.6 | 0.133 | — | invention |
| C | 0.017 | 0.69 | 1.59 | — | — | 17.17 | 6.54 | 0.128 | 0.07 | |
| D | 0.109 | 0.54 | 0.84 | — | — | 17.21 | 6.79 | 0.049 | 0.008 | comparative |
| E | 0.056 | 0.34 | 0.97 | — | — | 18.19 | 8.02 | 0.034 | 0.007 | |
| F | 0.022 | 0.38 | 0.95 | — | | 18.28 | 9.78 | 0.033 | 0.009 | |

(Notes)
The steel of marked A–C corresponds to SUS301L
The steel of marked D corresponds to SUS301
The steel of marked E corresponds to SUS304
The steel of marked F corresponds to SUS304L

TABLE 2

| | | Manufacturing conditions | | Properties | | | | | | |
|---|---|---|---|---|---|---|---|---|---|---|
| | | | | After final annealing | | | After temper rolling | | | |
| | | | | Recrystallized grains | | | | | | |
| Run No. | Steel mark | Reduction of temper rolling (%) | Aging Temp. (° C.) | Grain diameter (μm) | Area ratio (%) | Hardness (Hv) | Amount of α' (%) | Hardness (Hv) | Formability | Permanent set (%) |
| 1 | A | 40 | 300 | 1.5 | 94.8 | 302 | 58.6 | 463 | ○ | 56.5 |
| 2 | A | 40 | 300 | 2.3 | 100 | 269 | 61.5 | 452 | ○ | 55.5 |

TABLE 2-continued

| | | | | | | | | | | |
|---|---|---|---|---|---|---|---|---|---|---|
| 3 | B | 40 | 300 | 1.2 | 88.9 | 317 | 57.1 | 466 | ○ | 56.8 |
| 4 | B | 40 | 300 | 2 | 100 | 275 | 60.9 | 457 | ○ | 56 |
| 5 | C | 40 | 300 | 1 | 85.7 | 326 | 56.3 | 468 | ○ | 57 |
| 6 | C | 40 | 300 | 1.8 | 100 | 283 | 60.4 | 461 | ○ | 56.3 |
| 7 | B | 40 | 300 | 0.8 | 61.9 | 343 | 70.5 | 476 | ○ | 57.7 |
| 8 | B | 30 | 300 | 1.2 | 88.9 | 317 | 41.2 | 443 | ○ | 54.6 |
| 9 | B | 60 | 300 | 1.2 | 88.9 | 317 | 70.5 | 497 | ○ | 59.5 |
| 10 | B | 66 | 300 | 1.2 | 88.9 | 317 | 100 | 498 | ○ | 60.1 |
| 11 | B | 40 | 300 | 4.7 | 100 | 232 | 67.8 | 464 | ○ | 56.6 |
| 12 | D | 40 | 300 | — | — | 325 | 80.9 | 474 | X | 47.5 |
| 13 | D | 40 | 300 | 12 | 100 | 203 | 90.8 | 463 | X | 51.5 |
| 14 | D | 60 | 300 | 25 | 100 | 175 | 100 | 525 | X | 41.7 |
| 15 | E | 40 | 300 | — | — | 340 | 20 | 392 | X | 33.7 |
| 16 | E | 40 | 300 | 20 | 100 | 164 | 15 | 381 | ○ | 47.2 |
| 17 | E | 60 | 300 | 28 | 100 | 155 | 24 | 412 | X | 36.2 |
| 18 | F | 40 | 300 | — | — | 305 | 5 | 367 | X | 30.2 |
| 19 | B | 28 | 300 | 1.2 | 88.9 | 317 | 38.4 | 438 | ○ | 54.1 |
| 20 | F | 26 | 300 | 18 | 100 | 208 | 34.3 | 321 | ○ | 29.8 |

| | | Properties After aging | | | | | |
|---|---|---|---|---|---|---|---|
| Run No. | Steel mark | Chromium nitrides observed | Hardness (Hv) | Increase in strength ΔHv | Permanent set (%) | Fatigue properties | |
| 1 | A | Yes | 524 | 61 | 61.6 | ○ | — |
| 2 | A | Yes | 522 | 70 | 61.4 | ○ | — |
| 3 | B | Yes | 531 | 65 | 62.1 | ○ | — |
| 4 | B | Yes | 528 | 71 | 61.9 | ○ | — |
| 5 | C | Yes | 538 | 70 | 62.6 | ○ | — |
| 6 | C | Yes | 535 | 74 | 62.4 | ○ | — |
| 7 | B | Yes | 527 | 51 | 61.4 | ○ | — |
| 8 | B | Yes | 517 | 74 | 61.1 | ○ | — |
| 9 | B | Yes | 568 | 71 | 64.6 | ○ | — |
| 10 | B | Yes | 580 | 82 | 67.8 | ○ | — |
| 11 | B | Yes | 533 | 69 | 62.2 | ○ | — |
| 12 | D | No | 494 | 20 | 49.3 | X | *1 |
| 13 | D | No | 491 | 28 | 54 | X | *2 |
| 14 | D | No | 546 | 21 | 43.1 | X | — |
| 15 | E | No | 401 | 9 | 34.8 | X | *3 |
| 16 | E | No | 389 | 8 | 48.3 | ○ | — |
| 17 | E | No | 423 | 11 | 37.4 | X | — |
| 18 | F | No | 375 | 8 | 31.3 | X | *3 |
| 19 | B | Yes | 486 | 48 | 58.6 | ○ | — |
| 20 | F | Yes | 342 | 21 | 31.4 | X | — |

Note:
*1: Expanded grains and carbides present after annealing
*2: Carbides present afater annealing
*3: Expanded grains present after annealing According to the present invention, a stainless steel sheet which corresponds to SUS301L and in which the average grain diameter of recrystallized grains in a recrystallized structure after final annealing is at most 5 μm and the area ratio thereof is at least 50%, and which is manufactured by subsequently carrying out temper rolling with a reduction of at least 30% has a structure including strain induced martensite with an area ratio of at least 40%. This stainless steel sheet has good workability, and it can be subjected to bead formation without the formation of cracks.

If this stainless steel sheet is subjected to aging at a relatively low temperature of 300° C., it exhibits an increase in hardness of at least Hv 50, and it exhibits a high strength of greater than Hv 500 and permanent set properties exceeding 60%, and the fatigue properties are good. Precipitated chromium nitride was observed during observation of the microstructure after aging. These chromium nitride precipitated in the martensite phase having a lower nitrogen dissolution limit than austenite.

Accordingly, this stainless steel sheet is suitable for manufacture of a metal gasket, and it exhibits excellent workability which makes it possible to manufacture a gasket for recent high performance engines. In addition, the stainless steel is significantly strengthened by age hardening when it is subsequently subjected to heat treatment at a temperature of at most 350° C. during rubber coating which is carried out after bead forming, so a high performance metal gasket having a high strength due to precipitation strengthening can be inexpensively manufactured without performing special heat treatment for the purpose of aging.

In the comparative examples, none had both workability after temper rolling and performance after aging. In all of the comparative examples, the strengthening (ΔHv) due to aging at 300° C. was less than 50, and for many, ΔHv was 25 or less. In addition, considering only performance after aging, none satisfied all of hardness (Hv of at least 500), permanent set properties (at least 60%), and fatigue properties (○).

What is claimed is:

1. A stainless steel for a metal gasket having a chemical composition consisting essentially of, in mass %, C: at most 0.03%, Si: at most 1.0%

Mn: at most 2.0%, Cr: at least 16.0% and at most 18.0%,

Ni: at least 6.0% and at most 8.0%, N: at most 0.25%,

Nb: 0–0.30%, and a remainder of Fe and unavoidable impurities, and having a duplex phase structure of martensite with an area ratio of at least 40% and a remainder of austenite, or a single phase structure of martensite, and which can be used to manufacture a metal gasket having Hv of at least 500 and having chromium nitride precipitated in the martensite phase by again after forming.

2. A stainless steel for a metal gasket as set forth in claim 1, wherein the chemical composition contains at least 0.01% and at most 0.30% of Nb.

3. A method for producing a stainless steel for a metal gasket characterized by including a step of performing final annealing of a cold rolled steel having the chemical composition set forth in claim 1 to form a recrystallized structure having recrystallized grains with an average grain diameter of at most 5 $\mu$m having an area ratio of 50–100% and an uncrystallized portion having a area ratio of 0–50%, and a step of then performing temper rolling with a reduction of at least 30%.

4. A metal gasket comprising a stainless steel having the chemical composition set forth in claim 1 and having a duplex phase structure of martensite in which chromium nitride is precipitated with an area ratio of at least 40% and a remainder of austenite, or a single phase structure of martensite in which chromium nitride is precipitated, the gasket having Hv of at least 500.

5. A metal gasket as set forth in claim 4 on which rubber coating is performed.

6. A metal gasket as set forth in claim 5, wherein the gasket is for an engine.

7. A method of manufacturing a metal gasket comprising carrying out forming of the stainless steel of claim 1, and performing aging and rubber coating of the formed piece at 200–500° C.

8. A method as set forth in claim 7 wherein the aging is accomplished by heat treatment at a temperature of at most 350° C. at the time of rubber coating.

9. A metal gasket comprising a stainless steel having the chemical composition set forth in claim 2 and having a duplex phase structure of martensite in which chromium nitride is precipitated with an area ratio of at least 40% and a remainder of austenite, or a single phase structure of martensite in which chromium nitride is precipitated, gasket having Hv of at least 500.

10. A method of manufacturing a metal gasket comprising carrying out forming of the stainless steel of claim 2, and performing aging and rubber coating of the formed piece at 200–500° C.

11. A method of manufacturing a metal gasket comprising carrying out forming of the stainless steel of the stainless steel produced by the method set forth in claim 3, and performing aging and rubber coating of the formed piece at 200–500° C.

* * * * *